United States Patent [19]

Polacco

[11] Patent Number: 4,488,496

[45] Date of Patent: Dec. 18, 1984

[54] PLATFORM STRUCTURE OF THE PALLET TYPE

[76] Inventor: Giorgio Polacco, Via Arimondi, 2/2 - Padova, Italy

[21] Appl. No.: 344,664

[22] Filed: Feb. 1, 1982

[30] Foreign Application Priority Data

Feb. 6, 1981 [IT] Italy ..... 41522 A/81

[51] Int. Cl.[3] ..... B65D 19/38

[52] U.S. Cl. ..... 108/51.3; 108/57.1

[58] Field of Search ..... 108/51.3, 51.1, 56.1, 108/56.3, 57.1; 206/599, 600

[56] References Cited

U.S. PATENT DOCUMENTS

| | | | |
|---|---|---|---|
| 2,455,197 | 11/1948 | Sullivan | 108/51.1 X |
| 2,906,480 | 9/1959 | Rowe | 108/57.1 X |
| 3,273,518 | 9/1966 | Shina | 108/51.3 |
| 3,434,435 | 3/1969 | Achermann | 108/51.3 |
| 3,861,326 | 1/1975 | Brown | 108/57.1 X |
| 4,391,202 | 7/1983 | Carter et al. | 108/51.3 |

FOREIGN PATENT DOCUMENTS

| | | | |
|---|---|---|---|
| 252584 | 6/1964 | Australia | 108/51.3 |
| 295405 | 1/1972 | Austria . | |
| 2137703 | 2/1973 | Fed. Rep. of Germany . | |
| 320635 | 2/1970 | Sweden | 108/51.1 |
| 931539 | 7/1963 | United Kingdom . | |
| 1097292 | 1/1968 | United Kingdom . | |

*Primary Examiner*—William E. Lyddane
*Assistant Examiner*—Peter R. Brown
*Attorney, Agent, or Firm*—Guido Modiano; Albert Josif

[57] ABSTRACT

A platform structure of the pallet type having on one side thereof a load bearing sheet structure and on the opposite side leg formations defining entry ways for a lifting fork prong and wherein the leg formation is made of at least partly corrugated sheet material. The leg formation comprises a pair of spaced apart coplanar flat strip portions attached to the sheet structure and between the flat strip portions and integral therewith two contiguous V-profiles extending lengthwise and parallel to each other. The two profiles define a valley of triangular shape into which a triangular reinforcement is inserted.

4 Claims, 6 Drawing Figures

PLATFORM STRUCTURE OF THE PALLET TYPE

BACKGROUND OF THE INVENTION

This invention relates to a portable platform of the pallet type.

Well known are the problems connected with load handling and transporting by means of pallet-type platforms, as known are the problems connected with the use and storage of such platforms, as well as to the recovery of the materials utilized in the construction of such pallets.

During the last few years, pallets have been made available which are formed from cardboard and utilized in particular for transporting a variety of objects, such as house appliances and sets, such pallets being adapted to form a unitary assembly with the goods loaded thereon.

The acceptance of this kind of pallets has been further increased by that the pallets can be easily stored, by virtue of their small thickness dimension and weight, and in a majority of cases recovered because inclusive of no metal parts.

While the requisites imposed on such pallet design and construction are quite substantial, not few drawbacks have emerged in the course of their practical application.

First of all, that of including ground engaging legs which are shaped like a double "W", that is of having a bearing surface which is limited to a single line.

This feature results after a short time in the yielding of the cardboard fibers at the foot area which encourages the absorption of moisture and weakens the foot itself under the applied load.

Another problem encountered is that of a low resistance to side thrust stresses, which may put the feet out of use, with consequent instability of the load supported by the pallet.

SUMMARY OF THE INVENTION

In view of the aforesaid situation, the task of the present invention is that of providing a pallet structure effective to overcome the above drawbacks, while affording higher strength features suitable to meet both the load and the side thrust stresses.

Within this task it is an object of the invention to provide a pallet having legs the bearing base whereof is not limited to a line, but rather to a suitable surface area, such as to distribute the load over several points.

Another object of this invention is to provide a novel pallet which is formed from cardboard throughout, or from a similar material, suitably folded to provide a continuous strong structure capable of withstanding side thrust stresses.

Yet another object is to provide such a pallet including reinforcement elements intended for insertion into hollows formed by folds such as to make the pallet more rigid and accordingly capable of absorbing even the heaviest loads with a differentiated pattern.

Yet another object of this invention is to provide a pallet which can be fork engaged from any of its four sides, i.e. one which is suitably provided with segmented resting feet.

Yet another object of this invention is to provide such a pallet structure effective to be made through the utilization of nearly conventional equipment and know-how, so as to, on one side, lower the production costs and on the other side, improve the daily output.

The aforesaid and other tasks and objects as well as other objects, such as will be more apparent hereinafter, are achieved by a platform structure of the pallet type having on one side thereof a load bearing face and on the opposite side thereof a leg formation with entry ways for the fork of e.g. a lift truck and wherein the leg formation is made of at least partly corrugated sheet material, characterized in that the corrugations of said sheet material define elongated leg forming ridges and valleys interposed between said ridges and coextensive therewith, said valleys opening outwards from said opposite side and wherein reinforcing elements are inserted in at least part of said valleys and in engagement with said ridges.

BRIEF DESCRIPTION OF THE DRAWINGS

Further features and advantages of the invention will be more clearly apparent from the following detailed description of a preferred, but not limitative, embodiment thereof, as illustrated by way of example only in the accompanying drawings, where.

DESCRIPTION OF THE PREFERRED EMBODIMENTS

Figure 1:
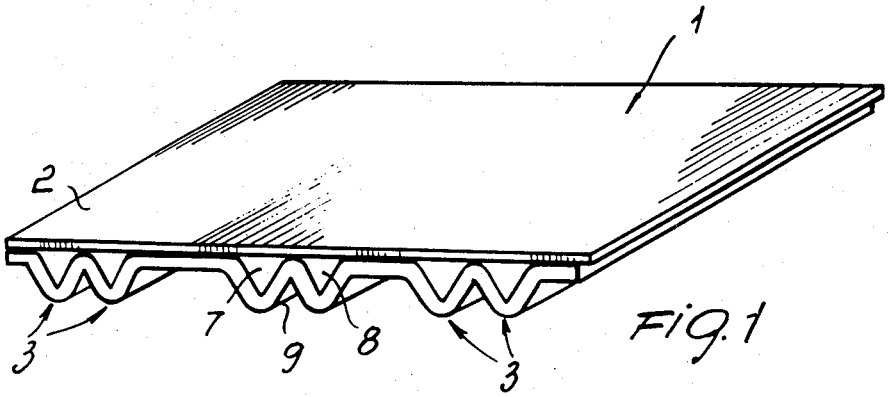
FIG. 1 is an overall, perspective view of the inventive platform.
Figure 2:
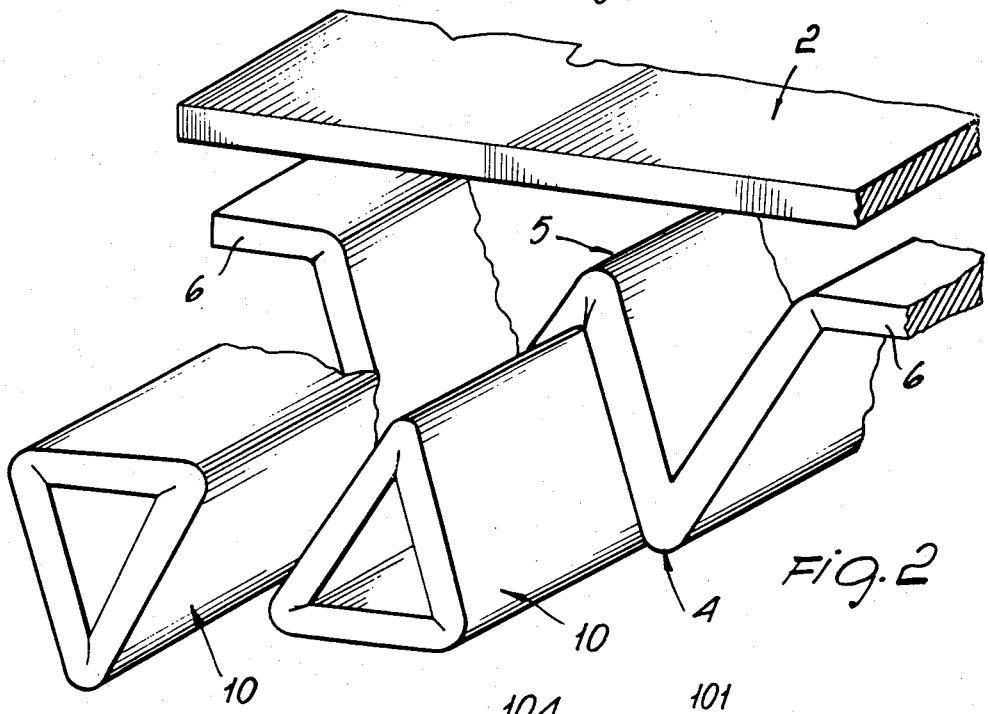
FIG. 2 is a fragmentary exploded view in perspective of the component parts of this invention.

With reference to the drawing figures, the numeral 1 designates generally a platform of the pallet type according to this invention, which comprises substantially two essential parts, a load supporting board or face 2 and ground engaging feet or legs 3.

The latter have in particular a V-like or W-like configuration or profile, thereby the part contacting the ground is restricted to a line.

Thus, the contact edge 4, which constitutes the vertex of the double fold or pleat automatically adapts itself to the ground irregularities.

Figure 3:
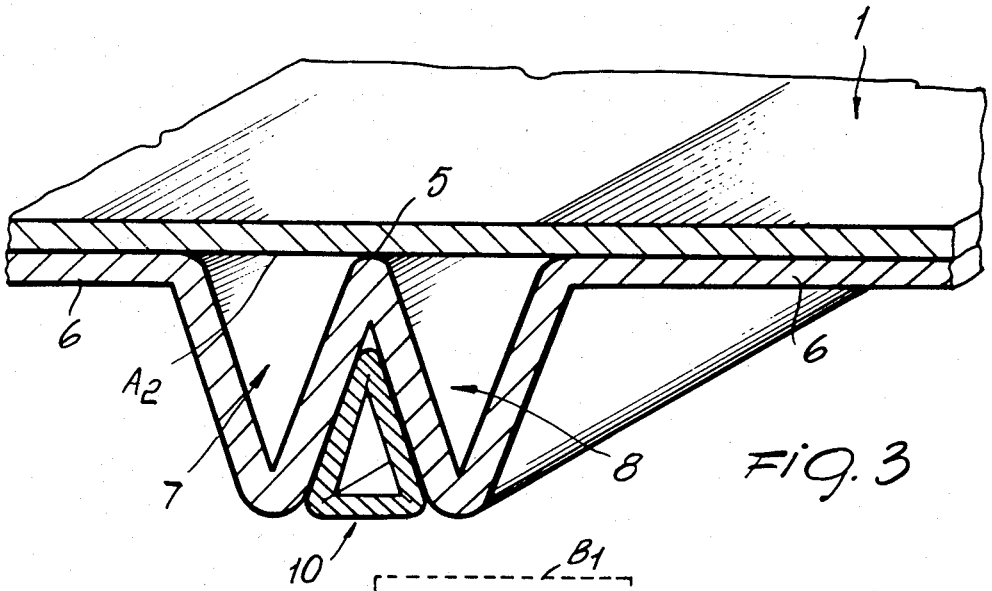
FIG. 3 is a partly sectional view of a foot and inner reinforcement.

As shown more clearly in FIG. 3, the fold pattern results in providing two edges, indicated at 4, which extend on the same plane A, while the upper vertex, indicated at 5, normally in disassembled and also in assembled condition protrudes above the upper alignment plane A2, defined by the wing segments 6.

The latter peculiar feature allows the contact surface area between the edge 5 and surface 2 to be increased owing to mutual deformation upon assemblage to ensure an improved association by glueing.

The segments or strips 6 separating one fold pair from the next constitute a further contact and glueing or cementing area located between said surface 2 and the resting feet or folds 3.

In order to improve the resistance to the stresses induced by side thrust forces, and of course, also to the stresses imposed by the load, provision is made for the insertion, into one of the hollows 7, 8 or 9, of one or more reinforcements.

Said reinforcement, generally indicated at 10, is obtained by folding a cardboard band such as to arrange it into a triangular cross-section or cross-section mating that of one hollow.

Said reinforcements 10 have the function to increase the ground engaging surface area and retain unaltered the parallel relationship and equispacing of the folds or V-profiles. For the purpose and as visible in FIG. 3 the base side of the triangular reinforcement 10 closes the aperture between the vertexes of the V-profiles.

It will be appreciated that in the embodiment described thus far, the position of the individual foot pairs may be either equidistant or differentiated in accordance with the applications and the extension thereof may be equal to the width dimension of the upper surface 2.

Figure 4:
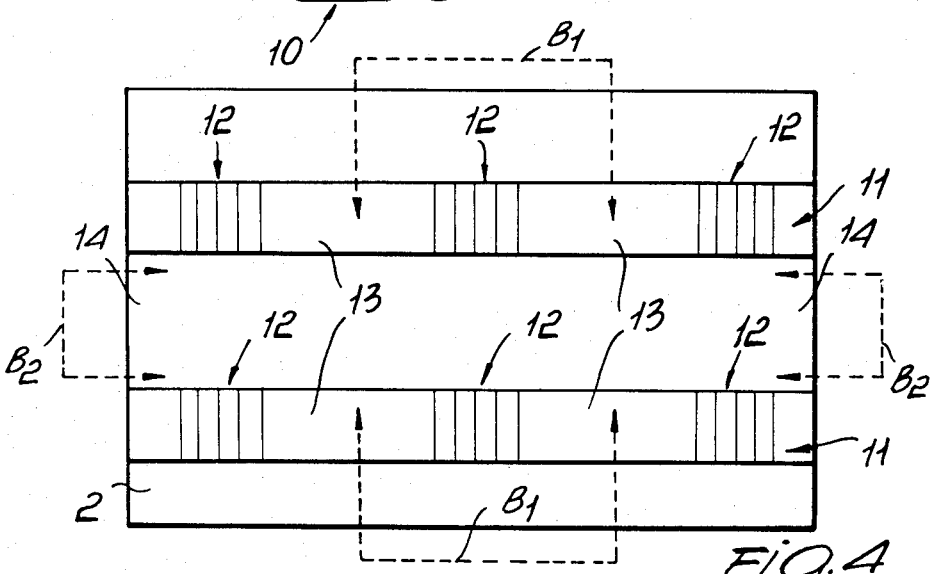
FIG. 4 shows a plan view of a platform which can be fork engaged from any of its four sides.
Figure 5:
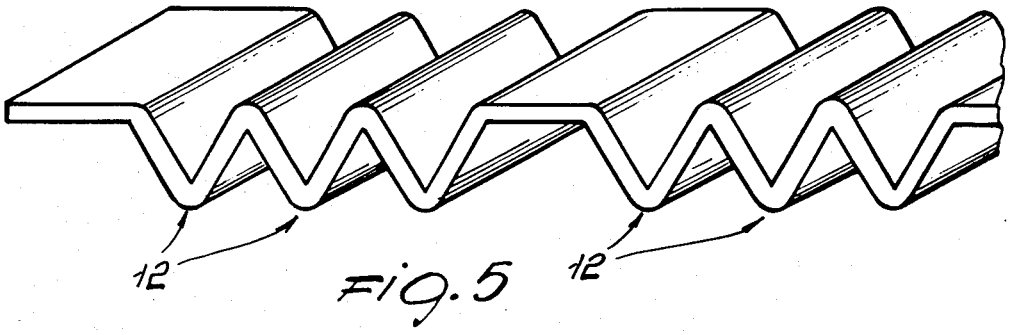
FIG. 5 shows a support strip having a plurality of V-like folds.

However, as may be noted, the platform so configured can only be fork-engaged from two well defined sides, hence in FIGS. 4 and 5, a platform is shown which is the equivalent of the former except for the fact that the ground is engaged by means of bands indicated at 11 having the same length as the platform but a smaller width.

Said bands 11 are provided with a plurality of pairs of V-like folds, indicated at 12, which are adapted to form, when associated with the surface 2, the platform resting feet.

Thus, as may be seen in FIG. 4, by arranging two or more bands 11 at the lower region of the rectilinear plane 2, a platform is achieved which can be fork-engaged from any of its four sides.

These four entry ways, indicated at B1 and B2, allow the pallet to be engaged with forks in a normal manner, by inserting the prongs of the fork lift truck into the spaces 13 defined by each foot, and in the other case by inserting them into the interspace 14 created by the two bands or externally to the same.

It will be apparent that the invention achieves all of its objects, and first of all that of providing a pallet-type platform which is extremely functional, versatile and of low cost, thanks to the use of cardboard both for the load bearing board and the supporting feet.

It is particularly noteworthy that no reinforcement parts of metal have been provided, thus facilitating the operations of integral recovery of the material.

It should be further noted that a band provided with resting feet has been provided which, when suitably combined with others, enables the achievement of a platform which can be fork-engaged from any of its four sides.

A further advantage achieved is that of providing a suitable reinforcement for the resting feet, whereby the strength of the feet under load is generally improved.

Figure 6:
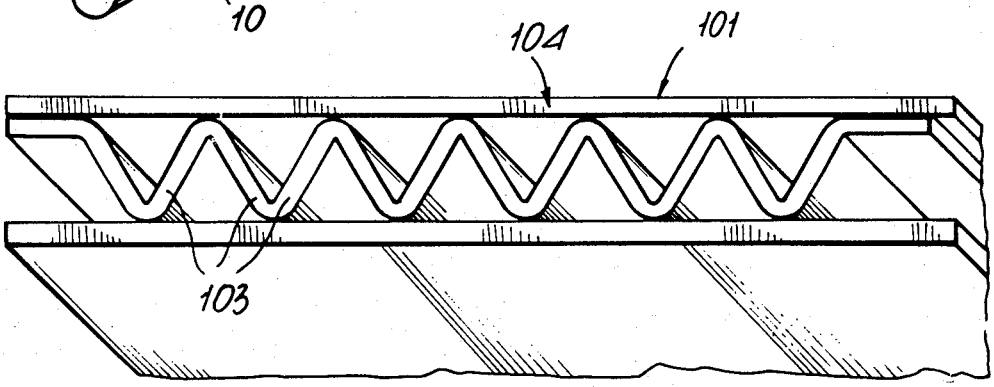
FIG. 6 is a perspective view of a packaging panel formed from elements provided with spacers shaped like a double "W".

As a last embodiment, which can be still referred to the teachings set forth hereinabove, in FIG. 6, a packaging stillage 101 is shown which is composed of a middle portion resulting from plural folds or pleats 103 interposed continuously between two flat plate elements 104.

This stillage, constructed in accordance with the technical teachings described hereinabove, makes it possible to complete the range of the elements intended to make the transportation of palletized goods reliable.

Further modifications may be introduced occasionally in practicing the invention, while the material use and dimensions may be any selected ones to meet individual requirements.

I claim:

1. A platform structure of the pallet type having a lengthwise and a widthwise extension and on one side thereof a load bearing sheet structure with a load bearing face and a back face and on the opposite side thereof at least two leg formations defining therebetween entry ways for a lifting fork prong and wherein each leg formation is made of at least partly corrugated sheet material, wherein, according to the improvement, each said leg formation comprises a pair of spaced apart coplanar flat strip portions attached to said back face of said sheet structure, and between said flat strip portions and integral therewith two contiguous V-profiles extending lengthwise and parallel to each other, each V-profile having a free vertex edge at a distance from said back face, said two profiles defining a valley of triangular shape therebetween and opening away from said back face, the aperture of said valley being defined by the distance between the free vertex edges of said contiguous V-profiles and within said valley a triangular reinforcement inserted therein, said triangular reinforcement having its base side closing said aperture and cooperating with said free edges of said V-profile to define together therewith an increased resting surface for said platform structure, and to prevent deformation of said V-profile.

2. A structure according to claim 1, wherein more than one of said leg formations are arranged in aligned relationship to each other and at a distance from each other allowing insertion therebetween of a lifting fork prong.

3. A structure according to claim 1, wherein more than one of said leg formations are arranged in side by side relationship at a distance from each other and with a length of the V-profiles shorter than the lengthwise extension of said platform thereby to define with said strip portions and said V-profiles integral to each other a band of spaced apart leg formations extending widthwise to said platform, the distance between the successive leg formations allowing insertion therebetween of a lifting fork prong.

4. A structure according to claim 3, wherein more than one of said bands are arranged at a distance from and parallel to each other widthwise to said platform and with said leg formations in alignment relationship with each other and wherein said distance between said bands and said distance between said leg formations allowing insertion therebetween of a lifting fork prong, thereby allowing insertion of a prong from four sides of the platform.

* * * * *